US008191197B1

(12) United States Patent
Hunsucker

(10) Patent No.: US 8,191,197 B1
(45) Date of Patent: Jun. 5, 2012

(54) NON-PERMANENT MARKER BOARD ERASER APPARATUS

(76) Inventor: Michael J. Hunsucker, Weston, FL (US)

( * ) Notice: Subject to any disclaimer, the term of this patent is extended or adjusted under 35 U.S.C. 154(b) by 236 days.

(21) Appl. No.: 12/765,243

(22) Filed: Apr. 22, 2010

(51) Int. Cl.
*B43L 21/00* (2006.01)

(52) U.S. Cl. ..... 15/246; 15/97.1; 15/98; 434/417

(58) Field of Classification Search ..... 15/97.1, 15/98, 103, 103.5, 246; 434/417
See application file for complete search history.

(56) References Cited

U.S. PATENT DOCUMENTS

| | | | | |
|---|---|---|---|---|
| 2,167,296 | A * | 7/1939 | Farmer | 15/98 |
| 3,163,943 | A * | 1/1965 | Bell | 434/417 |
| 3,731,335 | A | 5/1973 | Chrisp | |
| 3,858,265 | A * | 1/1975 | Schlick | 15/77 |
| 5,216,776 | A | 6/1993 | Dennison | |
| 5,319,820 | A | 6/1994 | Forst | |
| 6,073,297 | A | 6/2000 | Lee | |
| 6,266,841 | B1 | 7/2001 | Cho | |
| 6,370,720 | B1 | 4/2002 | Jang | |
| 6,948,210 | B1 | 9/2005 | Shah | |

FOREIGN PATENT DOCUMENTS

| | | | |
|---|---|---|---|
| JP | 4-265059 | * | 9/1992 |
| JP | 10-315690 | * | 12/1998 |

* cited by examiner

*Primary Examiner* — Mark Spisich

(57) ABSTRACT

The non-permanent marker board eraser apparatus provides a basic design and construction that exposes minimal moving parts to erasure debris. The two-spaced apart horizontal guide rails are u-shaped and open outwardly. The vertical traveling eraser sections are motor powered and provide for drive from either upper first guide rail or the lower second guide rail via a rubberized wheel that fits within either of the two guide rails. The control buttons provide for selective eraser marker board contact. Each board travel is accompanied by automatic eraser return to a rest position outside of or to the edge of the board's marking surface. Cleaning fluid is also dispensed through the erasers.

14 Claims, 4 Drawing Sheets

NON-PERMANENT MARKER BOARD ERASER APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The advantages of automated non-permanent marker board erasure apparatus are evidenced by the number of board erasers previously introduced. One advantage, for example, is that a board user does not have to turn a back to a class. Other advantages include lack of personal exposure to chalk dust and time savings, to name but two. While other products, as noted above, have been presented for erasure use, several disadvantages exist. Among those are included but not limited to exposure of moving parts such as cables, belts and pulleys and their respective drive mechanisms to marker debris such as chalk. Still other disadvantages of previously proposed marker devices include excessive complexity, and therefore expense in initial cost as well as replacement and repair costs. Yet another disadvantage of previously resented automated board erasure devices is that a board user may often want to erase only a portion of a marker board yet is limited to total board erasure.

The present apparatus provides a basic pair of rails with traveling erasers that can be controlled to automatically erase a portion of as well as the entire marker board. Cleaning fluid dispensing is also provided. The control box is powered by conventional battery and plug-in electrical power.

FIELD OF THE INVENTION

The non-permanent marker board eraser apparatus relates to non-permanent marker boards and more especially to an automated eraser for same.

SUMMARY OF THE INVENTION

The general purpose of the non-permanent marker board eraser apparatus, described subsequently in greater detail, is to provide a non-permanent marker board eraser apparatus which has many novel features that result in an improved non-permanent marker board eraser apparatus which is not anticipated, rendered obvious, suggested, or even implied by prior art, either alone or in combination thereof.

To attain this, the non-permanent marker board eraser apparatus provides a basic design and construction that exposes minimal moving parts to debris. The two-spaced apart horizontal guide rails are u-shaped and may be positioned to open outwardly or inwardly.

The vertical traveling erasers are motor powered and provide for drive from either the upper first guide rail or the lower second guide rail via a rubberized wheel that fits within either of the two guide rails. The control buttons communicating with the motor control/CPU provide for varied eraser travel. For example, the first button may provide that an eraser travel only one-third of the way across the board. The second button may provide that an eraser travel one-half of the way across the board, and the third button may provide that an eraser travel all of the way across the board. Sequential push of each button may choose which of the three erasers is depressed for contact with the board. Eraser depression toward the board is actuated by at least one activation device per each eraser section. Activation devices may be solenoids, electromagnets, or other actuating devices known in the arts. For example, pushing the first button once may provide for the first section of the eraser to travel across the first sector. Pushing the first button twice may choose the eraser second section to travel across the fourth sector. The motor control/CPU is, like many in the arts, programmable. Pushing and holding the three buttons simultaneously allows a user to program functions as chosen. Each eraser board travel is accompanied by automatic eraser return to a rest position outside of or to the edge of the board's marking surface. The extension of the erasers above the first guide rail and below the second guide rail provides for the rails to be affixed within the boundaries of the marker board if desired, and still function effectively in erasure. As an added benefit, the control buttons may be marked and color coded for easiest recognition in eraser operation.

While straight cut gears may be provided within the control box, the ideal embodiment provides beveled gears for more positive engagement and smoother, quieter operation. Further, the gears are ideally but not limited to right angle engagement. Identifying indicia may further be included on the control box next to the buttons. The control box may be provided in removable version whereby control box repair and replacement is more convenient. The reservoir with pump travels as a part of the control box and delivers fluid to the erasers for improved eraser board cleaning.

Thus has been broadly outlined the more important features of the improved non-permanent marker board eraser apparatus so that the detailed description thereof that follows may be better understood and in order that the present contribution to the art may be better appreciated.

An object of the non-permanent marker board eraser apparatus is to provide automated non-permanent marker board erasure.

Another object of the non-permanent marker board eraser apparatus is to provide as few moving parts as is possible.

A further object of the non-permanent marker board eraser apparatus is to expose as few moving parts as is possible to marker debris.

An added object of the non-permanent marker board eraser apparatus is to provide for marker board erasure incrementally, as chosen.

And, an object of the non-permanent marker board eraser apparatus is to provide automatic eraser return.

A further object of the non-permanent marker board eraser apparatus is to provide color recognition for the separate control buttons.

Yet another object of the non-permanent marker board eraser apparatus is to provide quiet and smooth eraser travel.

Still another object of the non-permanent marker board eraser apparatus is to provide cleaning fluid to a marker board.

These together with additional objects, features and advantages of the improved non-permanent marker board eraser apparatus will be readily apparent to those of ordinary skill in the art upon reading the following detailed description of presently preferred, but nonetheless illustrative, embodiments of the improved non-permanent marker board eraser apparatus when taken in conjunction with the accompanying drawings.

In this respect, before explaining the current embodiments of the improved non-permanent marker board eraser apparatus in detail, it is to be understood that the non-permanent marker board eraser apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved non-permanent marker board eraser apparatus. It is therefore important that the claims be regarded as including such equivalent constructions insofar as they do not depart from the spirit and scope of the non-permanent marker board eraser apparatus.

It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the non-permanent marker board eraser apparatus generally designated by the reference number 10 will be described.

Figure 1:
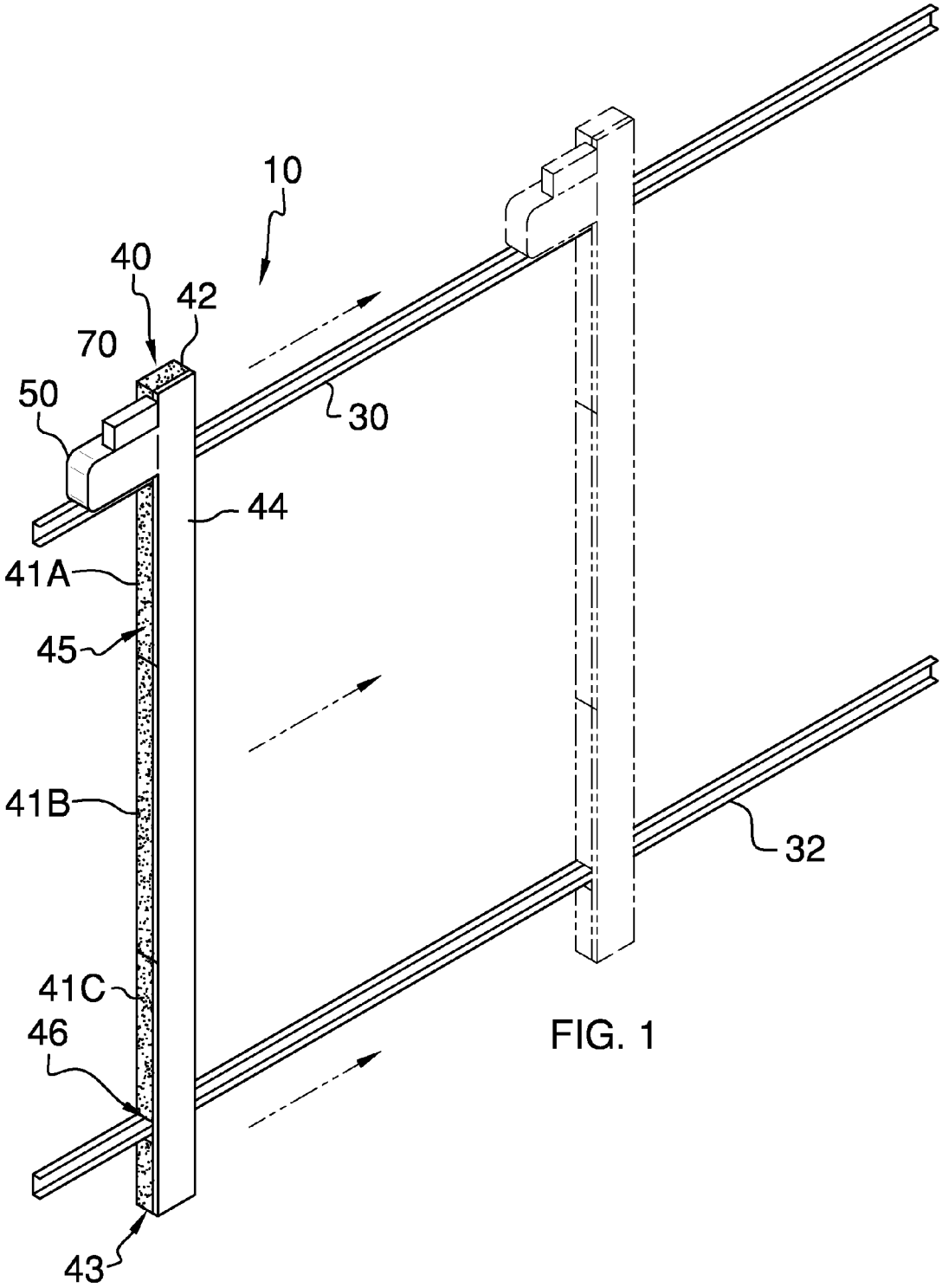
FIG. 1 is a perspective view.
Figure 2:
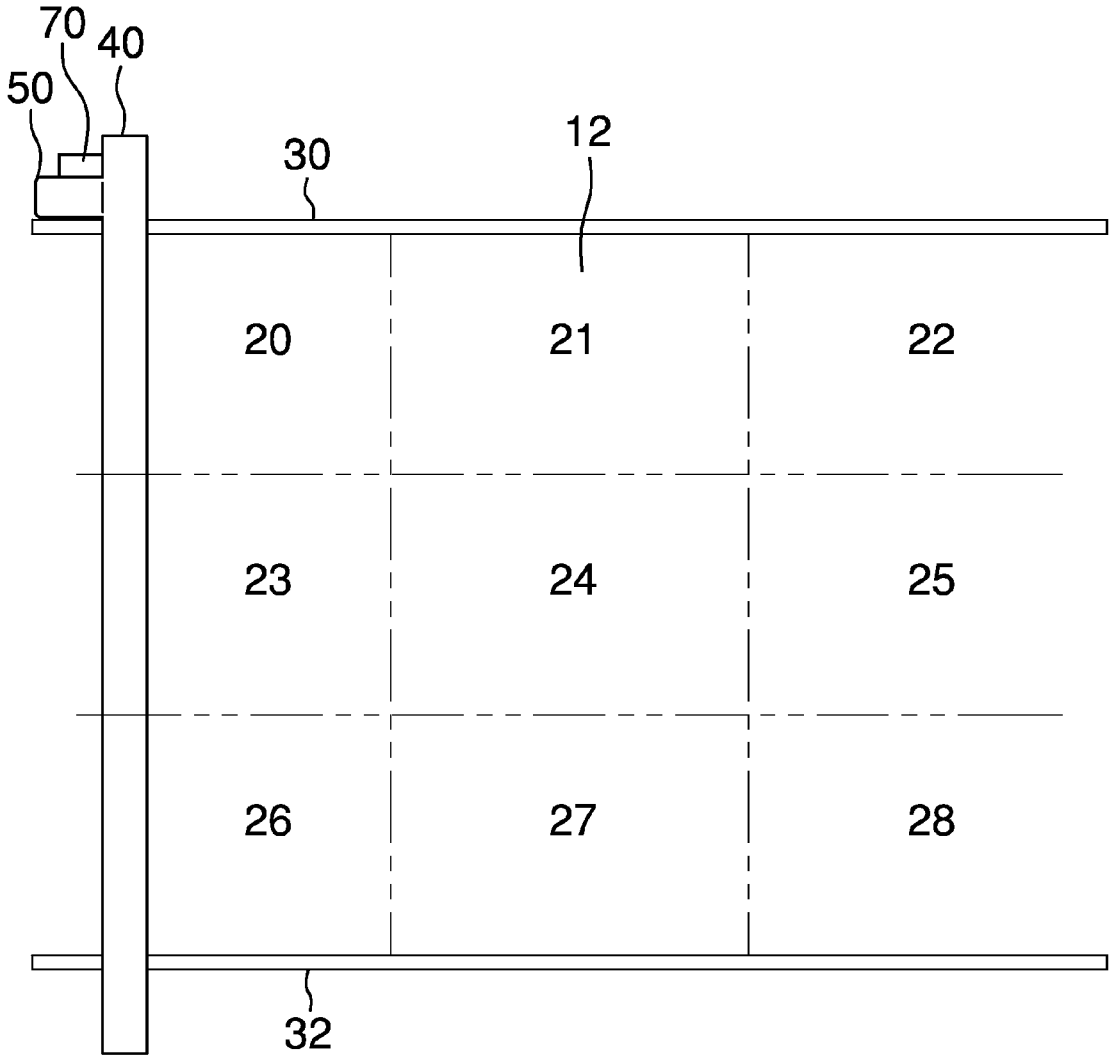
FIG. 2 is a front elevation view of the apparatus mounted against an existing marker board.

Referring to FIGS. 1 and 2, the apparatus 10 partially comprises the pair of horizontal spaced apart u-shaped guide rails comprising the first guide rail 30 and the second guide rail 32.

The guide rails are selectively mounted in communication with the existing marker board 12 such that the eraser 40 selectively travels across the marker board 12. The erase material 45 of each eraser section is depressed for direct communication with the marker board 12, when chosen by the control box 50. The eraser 40 is divided into three separately or cumulatively operated sections comprising the first section 41A, the second section 41B, and the third section 41C.

Referring again to FIG. 1, the apparatus 10 further comprises the vertical eraser 40 in movable communication with the guide rails and the marker board 12. The vertical eraser 40 comprises the inwardly disposed erase material 45 in communication with the outwardly disposed rigid outer member 44. The eraser 40 has an eraser top 42 spaced apart from an eraser bottom 43. The erase material 45 further comprises two identical spaced apart gaps 46. One of each of the gaps 46 is slideably fitted around one of each of the guide rails.

Figure 3:
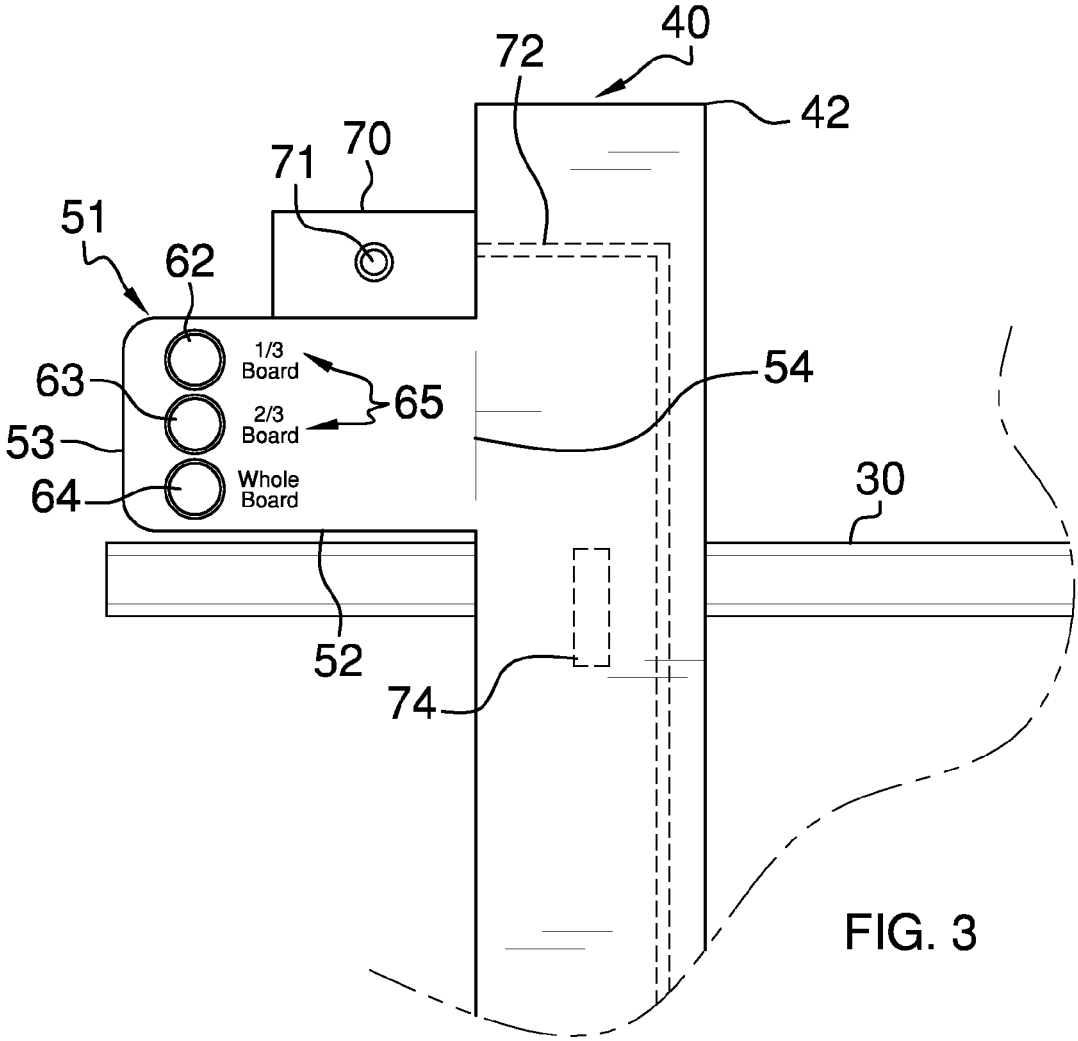
FIG. 3 is a front elevation view of the control box attached to the eraser outer member.

Referring to FIG. 3, the control box 50 has a top 51 spaced apart from a bottom 52, and a first end 53 spaced apart from a second end 54. The second end 54 is perpendicularly bonded to the eraser 40 outer member 44. The reservoir with pump 70 is disposed atop and in communication with the control box 50. The delivery tube 72 supplies fluid to the first section 41A, the second section 41B, and the third section 41C of the eraser 40, upon command by the pump control 71 and further instruction by the control box 50 so that a chosen section or sections receive cleaning fluid to be distributed to the marker board 12.

Figure 5:
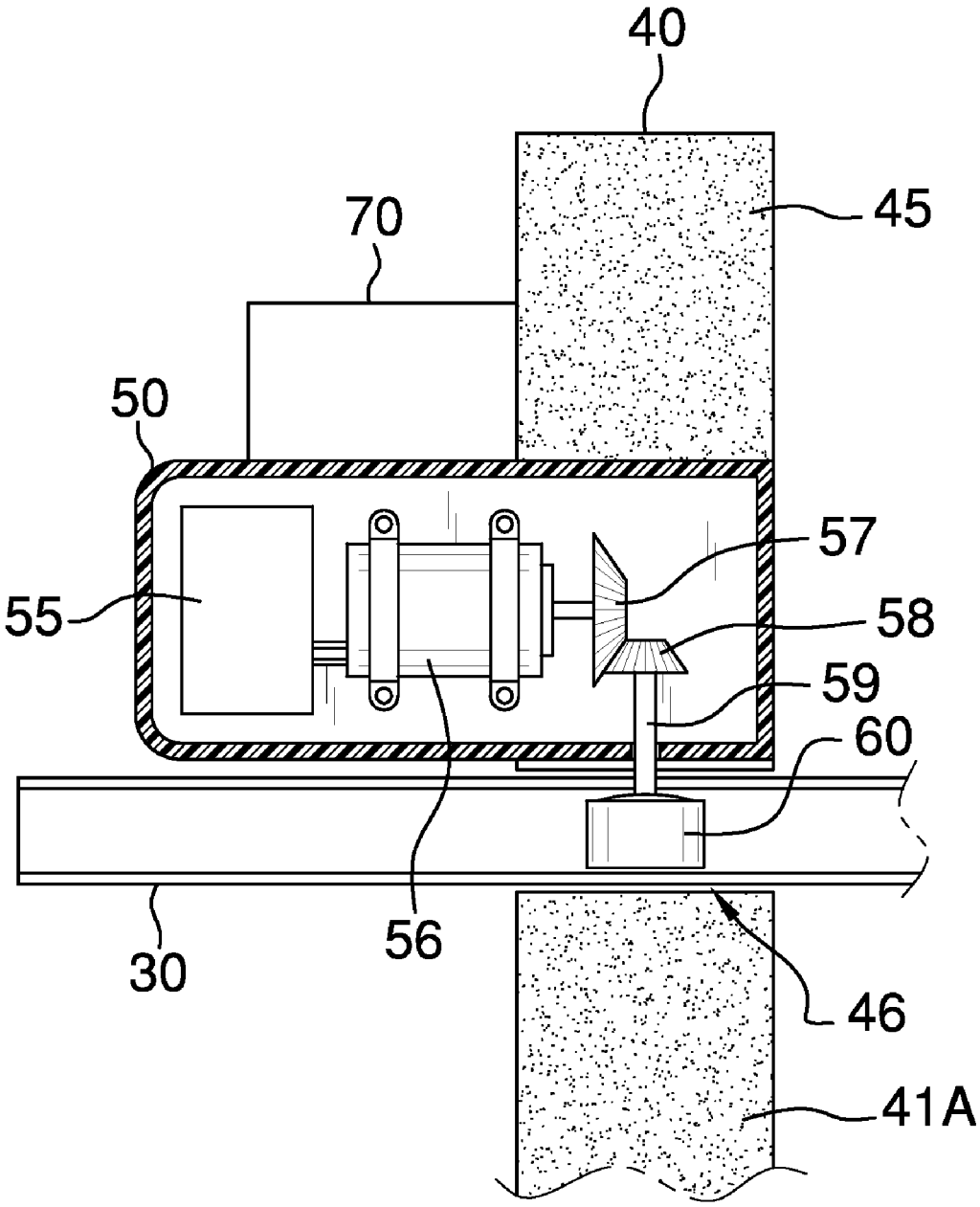
FIG. 5 is a partial cross sectional back view of FIG. 4

Referring to FIG. 5, the control box 50 further comprises the motor control/CPU 55 that partially comprises the three control buttons. The control box 50 further comprises the motor 56 that is in communication with the motor control/CPU 55. The control box 50 also comprises the rotating beveled pinion gear 57 that is in communication with the motor 56. The rotating beveled drive gear 58 within the control box 50 is in communication with the beveled pinion gear 57. The direct coupling of the pinion gear 57 to the drive gear 58 enhances smooth reliable travel of the eraser 40. Further, the bevels of the pinion gear 57 and the directly coupled drive gear 58 importantly combine to ensure quiet apparatus 10 operation.

Figure 4:
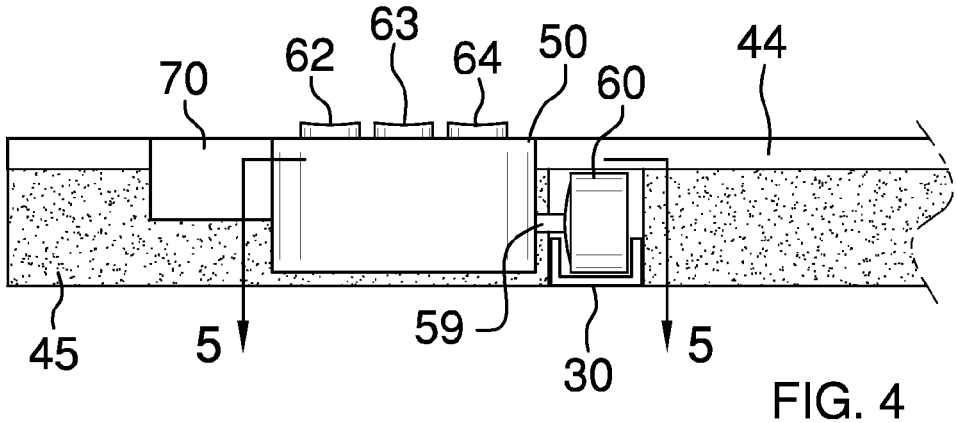
FIG. 4 is an end view of the control box with wheel engaged in the first guide rail.

Further referring to FIG. 5 and referring also to FIG. 4, the drive axle 59 is affixed to the beveled drive gear 58. The rubberized wheel 60 is affixed to the drive axle 59. The wheel 60 is selectively fitted within one of the u-shaped guide rails. These illustrations exhibit the wheel 60 fitted within the first guide rail 30.

Further referring to FIGS. 3 and 4, the control buttons comprise the first control button 62, the second control button 63, and the third control button 64. Referring again to FIG. 3, ideally, the first control button 62 further comprises a red color. The second control button 63 further comprises a green color. The third control button 64 further comprises a blue color. While colors may vary, the addition of colors to the control buttons provides further convenience to an operator in recalling control box 50 operation. An operator does not, after experience, have to then study each button or the related identifying indicia 65.

Referring again to FIGS. 1 and 3, each eraser 40 section is either recalled toward the eraser top 42 or depressed toward the marker board 12, selectively, by at least one actuation device 74, by command from the control box 50.

With respect to the above description then, it is to be realized that the optimum dimensional relationships for the parts of the non-permanent marker board eraser apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the non-permanent marker board eraser apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the non-permanent marker board eraser apparatus may be used.

Therefore, the foregoing is considered as illustrative only of the principles of the non-permanent marker board eraser apparatus. Further, since numerous modifications and changes will readily occur to those skilled in the art, it is not desired to limit the non-permanent marker board eraser apparatus to the exact construction and operation shown and described, and accordingly, all suitable modifications and equivalents may be resorted to, falling within the scope of the non-permanent marker board eraser apparatus.

What is claimed is:

1. A non-permanent marker board eraser apparatus comprising, in combination:

a pair of horizontal spaced apart u-shaped guide rails comprising a first guide rail and a second guide rail, the guide rails selectively mounted in communication with an existing marker board;

a vertical eraser in movable communication with the guide rails and the marker board, the vertical eraser comprising an inwardly disposed erase material in communication with an outwardly disposed rigid outer member, the eraser having an eraser top spaced apart from an eraser bottom, the erase material further having two identical spaced apart gaps, one of each of the gaps slideably fitted around one of each of the guide rails;

a trio of equal length eraser sections of the eraser, comprising a first section, a second section, and a third section;

a control box having a top spaced apart from a bottom, a first end spaced apart from a second end, the second end perpendicularly bonded to the eraser outer member, the control box further comprising:

a motor control/CPU;

a motor in communication with the motor control;

a rotating pinion gear in communication with the motor;

a rotating drive gear in communication with the pinion gear;

a drive axle affixed to the drive gear;

a rubberized wheel affixed to the drive axle, the wheel selectively fitted within one of the u-shaped guide rails;

wherein the motor control selectively causes each eraser section to move across the marker board, selectively depress into contact with the marker board, and automatically return to a previous position.

2. The apparatus according to claim 1 wherein the motor control further comprises a control causing the eraser to selectively travel ⅓, ⅔, and fully across the marker board.

3. The apparatus according to claim 2 wherein the gears further comprise a beveled pinion gear and a beveled drive gear.

4. The apparatus according to claim 3 wherein the gears are engaged at a right angle.

5. The apparatus according to claim 1 wherein the gears further comprise a beveled pinion gear and a beveled drive gear.

6. The apparatus according to claim 5 wherein the gears are engaged at a right angle.

7. A non-permanent marker board eraser apparatus comprising, in combination:

a pair of horizontal spaced apart u-shaped guide rails comprising a first guide rail and a second guide rail, the guide rails selectively mounted in communication with an existing marker board;

a vertical eraser in movable communication with the guide rails and the marker board, the vertical eraser comprising an inwardly disposed erase material in communication with an outwardly disposed rigid outer member, the eraser having an eraser top spaced apart from an eraser bottom, the erase material further having two identical spaced apart gaps, one of each of the gaps slideably fitted around one of each of the guide rails;

a trio of equal length eraser sections of the eraser, comprising a first section, a second section, and a third section;

a control box having a top spaced apart from a bottom, a first end spaced apart from a second end, the second end perpendicularly bonded to the eraser outer member, the control box further comprising:

a motor control/CPU comprising three control buttons;

a motor in communication with the motor control;

a rotating beveled pinion gear in communication with the motor;

a rotating beveled drive gear in communication with the beveled pinion gear;

a drive axle affixed to the beveled drive gear;

a rubberized wheel affixed to the drive axle, the wheel selectively fitted within one of the u-shaped guide rails;

wherein the motor control selectively causes each eraser section to move across the marker board, selectively depress into contact with the marker board, and automatically return to a previous position.

8. The apparatus according to claim 7 wherein the gears are engaged at a right angle.

9. The apparatus according to claim 8 wherein the control buttons each further comprises a separate color.

10. The apparatus according to claim 9 wherein the motor control/CPU is programmable.

11. The apparatus according to claim 8 wherein the motor control/CPU is programmable.

12. The apparatus according to claim 7 wherein the control buttons each further comprises a separate color.

13. The apparatus according to claim 12 wherein the motor control/CPU is programmable.

14. The apparatus according to claim 7 wherein the motor control/CPU is programmable.

* * * * *